US011573025B2

(12) United States Patent
Kim et al.

(10) Patent No.: US 11,573,025 B2
(45) Date of Patent: Feb. 7, 2023

(54) SERVER AND CONTROL METHOD THEREOF FOR A MULTI-AIR CONDITIONING SYSTEM INCLUDING GROUPING OF INDOOR UNITS

(71) Applicant: Samsung Electronics Co., Ltd., Suwon-si (KR)

(72) Inventors: Kyungjae Kim, Suwon-si (KR); Kwanwoo Song, Suwon-si (KR); Junhyung Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/166,428

(22) Filed: Feb. 3, 2021

(65) Prior Publication Data

US 2021/0247090 A1 Aug. 12, 2021

(30) Foreign Application Priority Data

Feb. 12, 2020 (KR) ..... 10-2020-0017135

(51) Int. Cl.
*F24F 11/63* (2018.01)
*F24F 11/58* (2018.01)
(Continued)

(52) U.S. Cl.
CPC ..... *F24F 11/58* (2018.01); *F24F 11/63* (2018.01); *F24F 2110/10* (2018.01); *F24F 2140/60* (2018.01)

(58) Field of Classification Search
CPC . F25B 13/00; F25B 49/02; F24F 11/30; F24F 11/56; F24F 11/58; F24F 11/63; F24F 2140/60; F24F 2110/10
See application file for complete search history.

(56) References Cited

U.S. PATENT DOCUMENTS 5,158,132 A * 10/1992 Guillemot ..... B29C 33/04 219/448.11
2007/0075584 A1* 4/2007 Moriya ..... H02J 1/14 307/9.1
(Continued)

FOREIGN PATENT DOCUMENTS

CN 107576108 A 1/2018
EP 1 881 277 A1 1/2008
(Continued)

OTHER PUBLICATIONS

International Search Report dated May 7, 2021, issued in International Application No. PCT/KR2021/001700.
(Continued)

*Primary Examiner* — Alicia M. Choi
(74) *Attorney, Agent, or Firm* — Jefferson IP Law, LLP

(57) ABSTRACT

A server is provided. The server includes a communicator and a processor configured to receive driving information of a plurality air conditioning devices through the communicator, identify an opening and closing cycle of a valve included in a pipe connected to each indoor unit of the plurality of air conditioning devices to control flow of a refrigerant, based on the driving information, group each indoor unit of the plurality of air conditioning devices into a plurality of groups based on the opening and closing cycle of the valve, based on a power consumed by the plurality of the air conditioning devices reaching a reference power amount, identify at least one group among the plurality of groups based on information about a control priority, and transmit a signal for driving control to at least one indoor unit included in the at least one group through the communicator.

20 Claims, 10 Drawing Sheets

(51) Int. Cl.
*F24F 140/60* (2018.01)
*F24F 110/10* (2018.01)

(56) References Cited

U.S. PATENT DOCUMENTS

| | | | | |
|---|---|---|---|---|
| 2009/0007575 | A1* | 1/2009 | Kaga | F25B 49/02 62/126 |
| 2010/0175311 | A1* | 7/2010 | Allen | B01F 27/272 422/187 |
| 2015/0219356 | A1* | 8/2015 | Ito | G05D 23/1904 165/266 |
| 2015/0233307 | A1* | 8/2015 | Stone | F01L 13/0005 123/90.32 |
| 2018/0147676 | A1* | 5/2018 | Havard, Jr | B23P 15/26 |
| 2019/0287147 | A1* | 9/2019 | Ingale | G06Q 30/04 |
| 2020/0363090 | A1* | 11/2020 | Jung | F25B 25/005 |
| 2020/0370794 | A1 | 11/2020 | Song et al. | |
| 2021/0247090 | A1* | 8/2021 | Kim | F24F 11/63 |
| 2021/0325075 | A1* | 10/2021 | Chen | F24F 1/0003 |

FOREIGN PATENT DOCUMENTS

| | | | | | |
|---|---|---|---|---|---|
| EP | 3792565 | A1 * | 3/2021 | | F24F 11/65 |
| JP | 07225043 | A * | 8/1995 | | F24F 11/02 |
| JP | 2685474 | B2 * | 12/1997 | | F25B 13/00 |
| JP | 2002-340390 | A | 11/2002 | | |
| JP | 2014-142686 | A | 8/2014 | | |
| JP | 2016-138666 | A * | 2/2016 | | F24F 11/02 |
| JP | 2016-138711 | A * | 8/2016 | | F24F 11/02 |
| JP | 2016138711 | A * | 8/2016 | | |
| JP | 2016-194375 | A * | 11/2016 | | F24F 11/02 |
| JP | 6685602 | B2 | 4/2020 | | |
| KR | 100677881 | B1 * | 8/2005 | | F24F 11/65 |
| KR | 10-0677881 | B1 | 2/2007 | | |
| KR | 10-2009-0053168 | A | 5/2009 | | |
| KR | 10-1035384 | B1 | 5/2011 | | |
| KR | 10-1263172 | B1 | 5/2013 | | |
| KR | 10-1368456 | B1 | 2/2014 | | |
| KR | 10-1415768 | B1 | 7/2014 | | |
| KR | 10-2015-0002145 | A | 1/2015 | | |
| KR | 10-1495159 | B1 | 2/2015 | | |
| KR | 10-2020-0134809 | A | 12/2020 | | |
| WO | 2006/112323 | A1 | 10/2006 | | |

OTHER PUBLICATIONS

Written Opinion dated May 7, 2021, issued in International Application No. PCT/KR2021/001700.

* cited by examiner

SERVER AND CONTROL METHOD THEREOF FOR A MULTI-AIR CONDITIONING SYSTEM INCLUDING GROUPING OF INDOOR UNITS

CROSS-REFERENCE TO RELATED APPLICATION(S)

This application is based on and claims priority under 35 U.S.C. § 119(a) of a Korean patent application number 10-2020-0017135, filed on Feb. 12, 2020, in the Korean Intellectual Property Office, the disclosure of which is incorporated by reference herein in its entirety.

BACKGROUND

1. Field

The disclosure relates to a server and a control method thereof. More particularly, the disclosure relates to a server controlling driving of an air conditioning device and a control method thereof.

2. Description of Related Art

In general, a plurality of air conditioning devices are installed in a large edifice such as a building, a department store, or the like. Accordingly, a user in a building may work, shop, or the like, in a pleasant environment.

However, when a plurality of air conditioning devices are operated, there may be a problem that an amount of power consumption is excessively increased. In order to solve this problem, it is necessary to control the operation of the air conditioning device which particularly consumes a large amount of power. In a related-art, a building manager may control the operation of some air conditioning devices among a plurality of air conditioning devices according to the manager's subjective judgment.

In an environment in which a plurality of air conditioning devices are installed, the manager may have a burden in controlling air conditioning devices one by one. In this case, the air conditioning device to be controlled may be determined by the subjective judgment of the building manager, so that it is difficult to manage power consumption efficiently.

Accordingly, there is a necessity of a method for efficiently managing a plurality of air conditioning devices in a group unit.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a server for controlling driving of a plurality of air conditioning devices in a group unit and a control method thereof.

Additional aspects will be set forth in part in the description which follows and, in part, will be apparent from the description, or may be learned by practice of the presented embodiments.

In accordance with an aspect of the disclosure, a server is provided. The server includes a communicator, and a processor configured to receive driving information of a plurality air conditioning devices through the communicator, identify an opening and closing cycle of a valve included in a pipe connected to each indoor unit of the plurality of air conditioning devices to control flow of a refrigerant, based on the driving information, group each indoor unit of the plurality of air conditioning devices into a plurality of groups based on the opening and closing cycle of the valve, based on a power consumed by the plurality of the air conditioning devices reaching a reference power amount, identify at least one group among the plurality of groups based on information about a control priority, and transmit a signal for driving control to at least one indoor unit included in the at least one group through the communicator.

The processor may receive the driving information including information about an opening and closing time of a valve including an opening time of the valve and a closing time of the valve through the communicator, and identify the opening and closing cycle of the valve based on the information about the opening and closing time of the valve.

The processor may identify a second point of time when the valve is closed again after the valve is closed at a first point of time and opened again, based on the information about the opening and closing time of the valve.

The first point of time may be a time when the valve is closed as temperature around the indoor unit reaches a temperature set to the indoor unit.

The processor may identify a group including an indoor unit connected with a pipe including a valve with an opening and closing cycle that is relatively shorter among the plurality of groups based on the information about the control priority and transmit a signal for the driving control to at least one indoor unit included in the group through the communicator.

The processor may transmit a signal to change a temperature set to the at least one indoor unit to the target temperature to the at least one indoor unit through the communicator based on the information about the target temperature matched to each indoor unit of the plurality of air conditioning devices.

The processor may, based on the temperature set to the at least one indoor unit being changed to the target temperature, identify whether a power consumption amount consumed by the plurality of air condition devices reaches the reference power amount, and based on identifying that the power amount consumed by the plurality of air conditioning devices reaches the reference power amount, identify a second group with a priority that is relatively lower than a first group including the at least one indoor unit based on the information about the control priority, and transmit a signal for driving control to at least one indoor unit included in the second group through the communicator.

The processor may transmit a signal to change the temperature set to the at least one indoor unit included in the second group to the target temperature to at least one indoor unit included in the second group through the communicator.

The processor may, based on the temperature set to the at least one indoor unit included in each of the plurality of groups being changed to the target temperature, identify whether power amount consumed by the plurality of air conditioning devices reaches the reference power amount, and based on identifying that the power amount consumed by the plurality of air conditioning devices reaches the reference power amount, transmit a signal to close the valve to the at least one indoor unit included in the first group through the communicator.

The processor may, based on a valve of at least one indoor unit included in each of the plurality of groups being closed, identify whether the power amount consumed by the plurality of air conditioning devices reaches the reference power amount, and based on identifying that the power amount consumed by the plurality of air conditioning devices reaches the reference power amount, transmit a signal to turn off to the at least one indoor unit included in the first group through the communicator.

In accordance with another aspect of the disclosure, a control method of a server according to an embodiment is provided. The control method includes receiving driving information of a plurality air conditioning devices, identifying an opening and closing cycle of a valve included in a pipe connected to each indoor unit of the plurality of air conditioning devices to control flow of a refrigerant, based on the driving information, grouping each indoor unit of the plurality of air conditioning devices into a plurality of groups based on the opening and closing cycle of the valve, and based on a power consumed by the plurality of the air conditioning devices reaching a reference power amount, identifying at least one group among the plurality of groups based on information about a control priority, and transmitting a signal for driving control to at least one indoor unit included in the at least one group.

The driving information may include information about an opening and closing time of a valve including an opening time of the valve and a closing time of the valve, and the identifying the opening and closing cycle of the valve may include identifying the opening and closing cycle of the valve based on the information about the opening and closing time of the valve.

The identifying the opening and closing cycle of the valve may include identifying a second point of time when the valve is closed again after the valve being closed at a first point of time and opened again, based on the information about the opening and closing time of the valve.

The first point of time may be a time when the valve is closed as temperature around the indoor unit reaches a temperature set to the indoor unit.

The transmitting of the signal may include identifying a group including an indoor unit connected with a pipe including a valve with an opening and closing cycle that is relatively shorter among the plurality of groups based on the information about the control priority and transmitting the signal for the driving control to at least one indoor unit included in the group.

The transmitting of the signal may include transmitting a signal to change the temperature set to the at least one indoor unit to the target temperature to the at least one indoor unit based on the information about the target temperature matched to each indoor unit of the plurality of air conditioning devices.

The transmitting of the signal may include, based on the temperature set to the at least one indoor unit being changed to the target temperature, identifying whether a power consumption amount consumed by the plurality of air condition devices reaches the reference power amount, and based on identification that the power amount consumed by the plurality of air conditioning devices reaches the reference power amount, identifying a second group with a priority that is relatively lower than a first group including the at least one indoor unit based on the information about the control priority, and transmitting a signal for driving control to at least one indoor unit included in the second group.

The transmitting of the signal may include transmitting a signal to change the temperature set to the at least one indoor unit included in the second group to the target temperature to at least one indoor unit included in the second group.

The transmitting of the signal may include, based on the temperature set to the at least one indoor unit included in each of the plurality of groups being changed to the target temperature, identifying whether a power consumption amount consumed by the plurality of air conditioning devices reaches the reference power amount, and based on identifying that the power amount consumed by the plurality of air conditioning devices reaches the reference power amount, transmitting a signal to close the valve to the at least one indoor unit included in the first group.

The transmitting may include, based on a valve of at least one indoor unit included in each of the plurality of groups being closed, identifying whether the power amount consumed by the plurality of air conditioning devices reaches the reference power amount, and based on identifying that the power amount consumed by the plurality of air conditioning devices reaches the reference power amount, transmitting a signal to turn off to the at least one indoor unit included in the first group.

According to various embodiments, a server capable of efficiently controlling a plurality of air conditioning devices in a group unit and a control method thereof may be provided.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken, in conjunction with the accompanying drawings, in which.

Throughout the drawings, it should be noted that like reference numbers are used to depict the same or similar elements, features, and structures.

DETAILED DESCRIPTION

Figure 1:
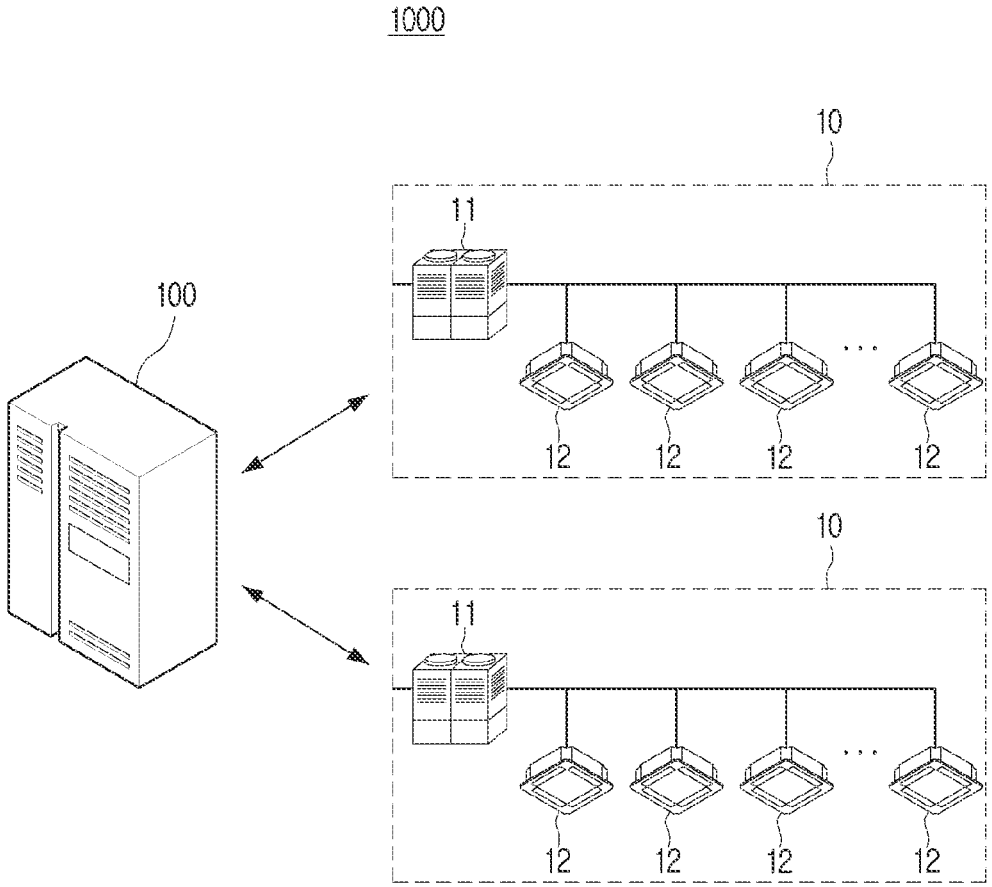
FIG. 1 is a diagram illustrating a power management system according to an embodiment of the disclosure.

The following description with reference to the accompanying drawings is provided to assist in a comprehensive understanding of various embodiments of the disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the disclosure. Accordingly, it should be apparent to those skilled in the art that the following description of various embodiments of the disclosure is provided for illustration purposes only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In this specification, expressions such as "have," "may have," "include," "may include" or the like represent presence of a corresponding feature (for example, components such as numbers, functions, operations, or parts) and does not exclude the presence of additional feature.

In this document, expressions such as "at least one of A [and/or] B," or "one or more of A [and/or] B," include all possible combinations of the listed items. For example, "at least one of A and B," or "at least one of A or B" includes any of (1) at least one A, (2) at least one B, or (3) at least one A and at least one B.

As used herein, the terms "first," "second," or the like may denote various components, regardless of order and/or importance, and may be used to distinguish one component from another, and does not otherwise limit the components.

If a certain element (e.g., first element) is described as "operatively or communicatively coupled with/to" or "connected to" another element (e.g., second element), it should be understood that the certain element may be connected to the other element directly or through still another element (e.g., third element). On the other hand, if it is described that a certain element (e.g., first element) is "directly coupled to" or "directly connected to" another element (e.g., second element), it may be understood that there is no element (e.g., third element) between the certain element and the another element.

Also, the expression "configured to" used in the disclosure may be interchangeably used with other expressions such as "suitable for," "having the capacity to," "designed to," "adapted to," "made to," and "capable of," depending on cases. Meanwhile, the term "configured to" does not necessarily mean that a device is "specifically designed to" in terms of hardware. Instead, under some circumstances, the expression "a device configured to" may mean that the device "is capable of" performing an operation together with another device or component. For example, the phrase "a processor configured to perform A, B, and C" may mean a dedicated processor (e.g., an embedded processor) for performing the corresponding operations, or a generic-purpose processor (e.g., a central processing unit (CPU) or an application processor) that can perform the corresponding operations by executing one or more software programs stored in a memory device.

A term such as "module," "unit," "part," and so on is used to refer to an element that performs at least one function or operation, and such element may be implemented as hardware or software, or a combination of hardware and software. Further, other than when each of a plurality of "modules," "units," "parts," and the like must be realized in an individual hardware, the components may be integrated in at least one module or chip and be realized in at least one processor (not shown).

Hereinafter, with reference to the attached drawings, embodiments will be described in detail.

FIG. 1 is a diagram illustrating a power management system according to an embodiment of the disclosure.

Referring to FIG. 1, a power management system 1000 according to an embodiment of the present disclosure may include a server 100 and a plurality of air conditioning devices 10.

The air conditioning device 10 is a device for controlling indoor temperature according to a cooling cycle or a heating cycle. The air conditioning device 10 may be a multi-type air conditioning device 10 including an outdoor unit 11 and a plurality of indoor units 12 connected to the outdoor unit 11, as shown in FIG. 1. Each of the plurality of the indoor units 12 may be arranged in different spaces and may operate in a cooling cycle or a heating cycle to control the temperature of each space. Some of the plurality of indoor units 12 may be arranged in the same space. The multi-type air conditioning device 10 is merely an embodiment, and the air conditioning device 10 may be implemented with a single-type air conditioning device 10 including one outdoor unit 11 and one indoor unit 12. Referring to FIG. 1, two air conditioning devices 10 are shown, but according to an embodiment, the air conditioning device 10 may be one or not less than three.

The air conditioning device 10 may include the outdoor unit 11 including a compressor which compresses a low-temperature and low-pressure gas refrigerant to a high-temperature and high-pressure and a condenser which condenses the high-temperature and high-pressure gas refrigerant into a high-temperature and high-pressure liquid refrigerant; the indoor unit 12 including an expansion valve which expands the high-temperature and high-pressure liquid refrigerant into a low-temperature and low-pressure gas refrigerant and an evaporator which evaporates a low-temperature and low-pressure gas refrigerant, and a valve which is included in a pipe connecting the outdoor unit 11 and the indoor unit 12 for controlling the flow of the refrigerant. The condenser may be included in the indoor unit 12, and the expansion valve may be included in the outdoor unit 11.

The air conditioning device 10 may also include a processor for controlling the overall operation of the air conditioning device 10. The processor of an air conditioning device 10 may control a plurality of hardware or software components included in the air conditioning device 10 and may perform various data processing and operations. For example, the processor of the air conditioning device 10 may control the flow of the refrigerant by controlling the opening and closing of the valve according to the indoor temperature. The processor of the air conditioning device 10 may be implemented as at least one general processor, a central processing unit (CPU), a digital signal processor, a system on chip (SoC), a microcomputer (MICOM), or the like.

The air conditioning device may communicate with a server 100 and may transmit and receive various data. The air conditioning device 10 may be communicatively connected to the server 100 via wire or wirelessly to transmit and receive various data to and from the server 100. As an example, the air conditioning device 10 may be connected to the server 100 through a communication cable or a Wi-Fi network, and transmit, to the server 100, operation information about the air conditioning device 10 (e.g., information about the operation mode of each indoor unit 12, information on the temperature set to each indoor unit 12, information on the opening/closing time of the valve controlling the flow of the refrigerant, information on the frequency of the power applied to the motor included in each outdoor unit 11, etc.) or information on the temperature around each indoor unit 12 of the air conditioning device 10, or the like.

This is merely exemplary, and the air conditioning device 10 may be communicatively connected to a repeater (not shown) and may transmit and receive data to and from the server 100 via a repeater (not shown). The repeater (not shown) is an electronic device connected to the server 100 by wire or wirelessly, and the air conditioning device 10 may be communicatively connected to a repeater (not shown) by wire or wirelessly, and may transmit the operation information of the air conditioning device 10, or information on the temperature around each indoor unit 12 of the air conditioning device 10, or the like, to the server 100 through the repeater (not shown).

The server 100 may group each indoor unit 12 of the plurality of air conditioning devices 10 into a plurality of groups based on the driving information (or operation information) received from the plurality of air conditioning devices 10. The server 100 may be included in the pipe connected to each indoor unit 12 of the plurality of air conditioning devices 10 based on the operation information received from the plurality of air conditioning devices 10 to identify the opening and closing cycle of the valve which controls the flow of the refrigerant, and may group each indoor unit of the plurality of air conditioning devices 10 into a plurality of groups based on the opening and closing cycle of the valve. A detailed description thereof will be described with reference to FIG. 2.

The server 100 may identify at least one group among a plurality of groups based on information on the control priority when the amount of power consumed by the plurality of air conditioning devices 10 reaches the reference power amount, and may transmit a signal for driving control to at least one indoor unit 12 included in at least one group. The signal for controlling the operation may be at least one of a signal for changing the temperature set to the indoor unit 12, a signal for closing the valve for controlling the flow of the refrigerant, or a signal for turning off the power of the indoor unit 12. The server 100 may identify a group including an indoor unit having a relatively short valve opening and closing cycle among a plurality of groups, and may transmit a signal for driving control to at least one indoor unit included in the identified group. This reflects that a space where an indoor unit with a relatively short valve opening/closing cycle is a space in which the insulation is low, and the amount of power consumed by the indoor unit installed in this space and the outdoor unit connected to the indoor unit is higher than the amount of power consumed by the indoor unit installed in other spaces and thus, there is necessity to control the power consumption.

The disclosure may uniformly control indoor units having high power consumption in group units. Accordingly, the disclosure may solve the burden of a building manager which has to control indoor units one by one in an environment in which a plurality of air conditioning devices are installed, and may efficiently manage a plurality of indoor units in group units.

Figure 2:
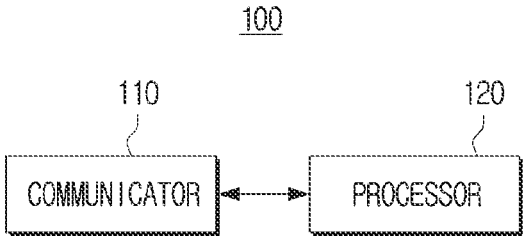
FIG. 2 is a block diagram illustrating a server according to an embodiment of the disclosure.

FIG. 2 is a block diagram illustrating a server according to an embodiment of the disclosure.

Referring to FIG. 2, the server 100 according to an embodiment includes a communicator 110 and a processor 120.

The communicator 110 may communicate with various external devices to transmit and receive various data. For example, the communicator 110 may communicate with the air conditioning device. The communicator 110 may be communicatively connected to the air conditioning device 10 through a wired communication method or a wireless communication method to transmit and receive various data to the air conditioning device 10. As an example, the communicator 110 may be connected to the air conditioning device 10 through a communication cable or a Wi-Fi network, and receive, from the air conditioning device 10, operation information about the air conditioning device 10 (e.g., information about the operation mode of each indoor unit 12, information on the temperature set to each indoor unit 12, information on the opening/closing time of the valve controlling the flow of the refrigerant, information on the frequency of the power applied to the motor included in each outdoor unit 11, etc.) or information on the temperature around each indoor unit 12 of the air conditioning device 10, or the like.

The communicator 110 may transmit a signal for driving control to the air conditioning device 10. The signal for driving control may be a signal for changing the temperature set in the indoor unit 12 of the air conditioning device 10, a signal for controlling the opening and closing of the valve controlling the flow of the refrigerant, and a signal for turning off the outdoor unit 11 or indoor unit 12 of the air conditioning device 10.

This is merely exemplary, and the communicator 110 may be communicatively connected to the repeater (not shown), and may transmit and receive data to and from the air conditioning device 10 through the repeater. The repeater (not shown) is an electronic device that is communicatively connected to the air conditioning device 10 in a wired or wireless communication manner. The communicator 110 may be communicatively connected to the repeater (not shown) in a wired or wireless communication manner, may receive information about the driving information of the air conditioning device 10 from the air conditioning device 10 through the repeater (not shown) or information about the temperature around each indoor unit 12 of the air conditioning device 10, or transmit signals for driving control to the air conditioning device 10 for via a repeater (not shown). The repeater (not shown) may be communicatively connected to each indoor unit 12 of the air conditioning device 10 to relay data transmission and reception between the server 100 and the indoor unit 12, and may be communicatively connected to the outdoor unit 11 of the air conditioning device 10 to relay data transmission and reception between the server 100 and the outdoor unit 11. In the latter case, the outdoor unit 11 may identify the indoor unit 12 for transmitting the data based on the identification information included in the data received from the repeater (not shown), and may transmit the data to the indoor unit 12 corresponding to the identification information.

The processor 120 is configured to control overall operations of the server 100. The processor 120 may control a plurality of hardware or software components connected to the processor 120 by driving operating system or applications and may perform various data processing and operations. The processor 120 may include at least one of the CPU, application processor (AP), or communication processor (CP). The processor 120 may be implemented as at least one general processor, a digital signal processor, an application specific integrated circuit (ASIC), SoC, MICOM, or the like.

The processor 120 may receive the driving information of a plurality of the air conditioning devices 10 through the communicator 110. The driving information may include information about the opening and closing cycle of the valve to control the flow of the refrigerant.

As described above, the air conditioning device 10 may include a valve included in a pipe for connecting the outdoor unit 11 and the indoor unit 12 to control flow of a refrigerant (hereinafter, control valve).

The air conditioning device 10 may control the opening and closing of the control valve based on the temperature around the indoor unit 12 and the temperature set in the outdoor unit 11. The air conditioning device may control the opening and closing of the control valve based on the indoor temperature and the desired temperature.

The air conditioning device 10 may detect the temperature around the indoor unit 12 through a temperature detection sensor in a state where the control valve is opened, and as the air conditioning device 10 operates in a cooling cycle, when the temperature around the indoor unit 12 reaches a preset temperature in the indoor unit 12 or a difference between the temperature around the indoor unit 12 and the temperature set in the indoor unit 12 is less than or equal to a threshold value, the air conditioning device 10 may close the control valve. For example, if the temperature around the indoor unit 12 is 30° C. and the temperature set to the indoor unit 12 is 20° C., the air conditioning device 10, while operating in the cooling cycle, may detect the temperature around the indoor unit 12 and if the temperature around the indoor unit 12 reaches 20° C. or the temperature around the indoor unit 12 reaches 20° C. and then becomes 19° C. (e.g., when the threshold value is 1° C.), the control valve may be closed. The air conditioning device 10 may stop the cooling operation and perform a blowing operation.

The air conditioning device 10 may open the control valve when, after closing the control valve, the temperature around the indoor unit 12 reaches the temperature set in the indoor unit 12 or when the difference between temperature around the indoor unit 12 and the temperature set in the indoor unit 12 is greater than or equal to a threshold value. For example, if the temperature set to the indoor unit 12 is 20° C., the air conditioning device 10 may close the control valve, and then if the temperature around the indoor unit 12 which was 19° reached 20° C., or when the temperature around the indoor unit 12 reaches 20° C. and then becomes 21° C. (e.g., the threshold value is 1° C.), the control valve may be opened. The air conditioning device 10 may stop the blowing operation and perform a cooling operation.

The air conditioning device 10 may transmit information about the opening and closing time of the control valve including the time of opening and closing of the control valve to the server 100, and the processor 120 may receive information on the opening and closing time of the control valve through the communicator 110.

The processor 120 may identify the opening and closing cycle of the control valve based on information on the opening and closing time of the control valve included in the driving information. The processor 120 may identify a second time point when the closed control valve is closed after the closed control valve is opened, from a first time point when the control valve is closed, based on the information on the opening and closing time of the control valve, and may identify the opening and closing cycle of the control valve based on the first and second time points. For example, if the first time point is t1 and the second time point is t2, the processor 120 may identify the difference between t2 and t1 to be the open/close cycle of the control valve.

The first time point may be a time when the control valve is closed as the temperature around the indoor unit reaches the temperature set to the indoor unit 12. The first time point may be, as an example described above, when the temperature set to the indoor unit is 20° C., the time when the control valve is closed in an example where the temperature around the indoor unit 12 having the temperature of 30° C. is reached 20° C. after the cooling operation of the air conditioning device 10, or the time when the control valve is closed after the temperature around the indoor unit 12 having the temperature of 30° C. to reach 20° C. and then 19° C. according to the cooling operation of the air conditioning device 10 (e.g., the threshold value is 1° C.). The air conditioning device 10 may transmit information about the time point of closing the control valve to the server 100 when the control valve is closed as the temperature around the indoor unit 12 reaches the temperature set to the indoor unit 12. This is merely one embodiment, and the air conditioning device 10 may transmit information about the opening and closing time of the control valve to the server 100 after the user command to turn on the air conditioning device 10 is input for air conditioning, and the processor 120 may identify the time when the control valve is first closed as the first time point as described above based on the information on the opening and closing time of the control valve. The processor 120 may identify a section in which the opening and closing of the control valve is in performed with a predetermined cycle based on information on the opening and closing time of the control valve, and may identify the time of the corresponding section to be the opening/closing cycle of the control valve.

The processor 120 may group each indoor unit 12 of the plurality of the air conditioning devices 10 into a plurality of groups based on the opening/closing cycle of the control valve. The processor 120 may group an indoor unit 12 with the same opening/closing cycle into the same group among a plurality of indoor units 12. For example, if the opening and closing cycle of the control valve included in the first and second indoor units is T1, and the opening and closing cycle of the control valve included in the third and fourth indoor units is T2, the processor 120 may group the first and second indoor units into the first group and group the third and fourth indoor units to the second group. The processor 120 may group the indoor unit 12 with a similar opening and closing cycle into the same group. The processor 120 may group the first and second indoor units in the same group if the opening and closing cycle of the control valve included in the first indoor unit is T1, the cycle included in the second indoor unit is T2, and the difference between T1 and T2 is less than or equal to a threshold value (e.g., one minute), the first and second indoor units may be grouped into the same group.

The processor 120 may transmit a signal for driving control to at least one indoor unit 12 included in at least one group among a plurality of groups through the communicator 110 based on the amount of power consumed by the plurality of the air conditioning devices 10.

When the amount of power consumed by the plurality of the air conditioning devices 10 reaches the reference power amount, the processor 120 may identify a group to be subject to driving control of the plurality of groups based on the information on the control priority.

The processor 120 may identify whether the amount of power consumed by the plurality of the air conditioning devices 10 reaches the reference power amount. The reference power amount is set according to a user command and may be set in a day unit, and also in various reference time units such as a monthly unit, weekly unit, hour unit, minute unit, or the like. For example, the reference power amount may be set to 1000 kwh/day. The processor 120 may identify whether the amount of power consumed by the plurality of the air conditioning devices 10 has reached the reference power amount based on information on the power consumption of the plurality of the air conditioning devices 10 received through the communicator 110.

If the amount of power consumed by the plurality of the air conditioning device 10 is predicted to reach the reference power amount, the processor 120 may identify a group subject to driving control among the plurality of groups based on the information on the control priority.

The processor 120 may identify an amount of power expected to be consumed by the plurality of the air conditioning devices 10 after a predetermined time, based on information on the power consumption of the plurality of air conditioning devices 10 received through the communicator 110, and may identify a group of driving control, among the plurality of groups based on the information on the control priority when the amount of power consumed by the plurality of the air conditioning devices 10 is predicted to reach the reference power amount after a preset time.

The control priority may be determined based on the opening and closing cycle of the control valve. The processor 120 may identify a group in which an indoor unit connected to a pipe including a valve having a relatively short valve opening/closing cycle among a plurality of groups to be a group for driving control based on the information on the control priority.

Figure 3A:
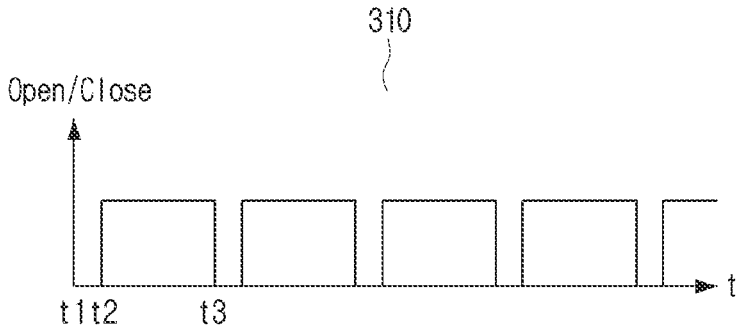
FIGS. 3A, 3B, and 3C are diagrams illustrating grouping a plurality of indoor units based on an opening and closing cycle of a valve according to various embodiments of the disclosure.
Figure 3B:
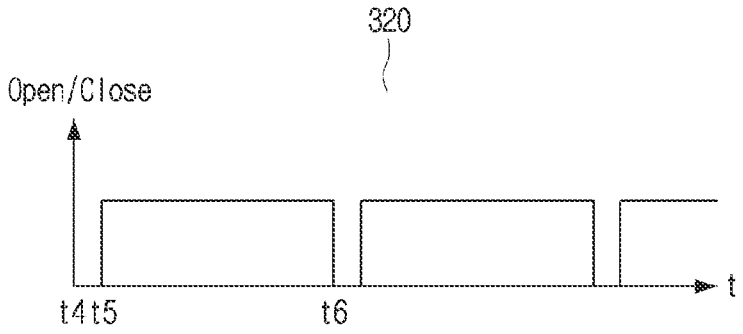
Figure 3C:
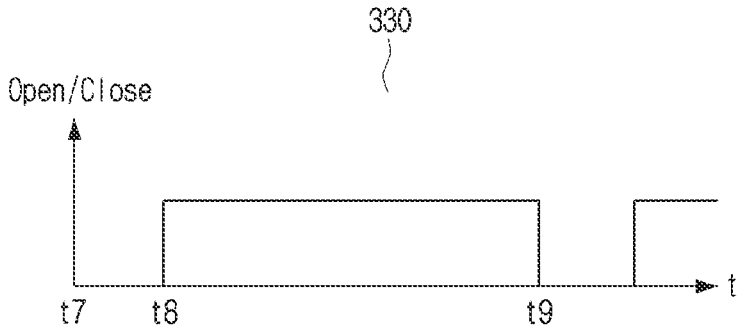

FIGS. 3A to 3C are diagrams illustrating an embodiment of grouping a plurality of indoor units based on an opening and closing cycle of a valve according to various embodiments of the disclosure Referring to FIGS. 3A to 3C, the processor 120 may receive information 310 about the opening and closing cycle of the first control valve from the first and second indoor units, receive information 320 about the opening and closing cycle of the second control valve from the third and fourth indoor units, and when receiving information 330 about the opening and closing cycle of the third control valve from the fifth indoor units, may group the first and second indoor units with the same (or, differences below the threshold) opening and closing cycle into a first group, the third and fourth indoor groups into a second group, and the fifth indoor unit into a third group.

When the amount of power consumed by the plurality of the air conditioning devices 10 reaches the reference power amount, the processor 120 may identify a group subject to the driving control among the plurality of groups based on information on the opening and closing period of the control valve.

The processor 120 may identify a group including an indoor unit connected with a pipe including the control valve having a relatively opening and closing cycle, among the plurality of groups, as a group subject to driving control. In the above-described embodiment, the processor 120 may identify a first group, among the first to third groups, including the first and second indoor units connected to the pipe having a control valve with a relatively opening and closing cycle as a group that is subject to driving control. The space in which the indoor unit connected to the pipe including a valve with a relatively short opening and losing cycle is a space with low thermal insulation, and the amount of power consumed by the indoor units installed in these spaces and the outdoor unit connected to the indoor unit may be higher than the amount of power consumed by the indoor unit installed in another space and the outdoor unit connected to the indoor unit so there is a necessity to control power consumed.

The processor 120 may transmit a signal for driving control through the communicator 110 to at least one indoor unit 12 included in a group subject to driving control among a plurality of groups. According to an embodiment of the disclosure, the processor 120 may transmit a signal for driving control to the outdoor unit 11 or a repeater (not shown).

The signal for driving control may be at least one of a signal for changing a temperature set in the indoor unit 12 included in a group to be subject to driving control, a signal for closing a control valve included in a pipe connected to the indoor unit 12 included in a group to be subject to driving control, or a signal to turn off the power of the indoor unit 12 included in a group of driving control.

The processor 120 may transmit, to the indoor unit included in a group subject to driving, a signal to change the temperature set to the indoor unit included in the group of the driving control to the target temperature based on the information on the target temperature matched to each indoor unit 12 of the plurality of the air conditioning device 10, through the communicator 110.

The target temperature may be determined based on the driving information of the plurality of air conditioning devices 10. The processor 120 may identify the time at which the temperature set in the indoor unit 12 is maintained according to the driving information of the air conditioning devices 10 received through the communicator 110. When the temperature set in the indoor unit 12 is maintained for a predetermined time or longer, the processor 120 may match the corresponding temperature to the target temperature of the corresponding indoor unit 12. For example, if 23° C. is set to a desired temperature in a first indoor unit and the first indoor unit operates for a predetermined time (e.g., 60 minutes) according to a desired temperature, the processor 120 may store the target temperature of the first indoor unit to 23° C. This is because if the desired temperature is maintained for greater than or equal to a predetermined time (i.e., when a user does not adjust the desired temperature), it may be seen that the user feels pleasant at the temperature, so if the temperature set in the indoor unit 12 is changed to the target temperature as the amount of power consumption reaches the reference power amount, user may still feel pleasant.

When a desired temperature maintained above a predetermined time is plural, the processor 120 may match a relatively highest desired temperature to a target temperature of the corresponding indoor unit 12. For example, if the first indoor unit maintains a desired temperature set at 20° C. for a predetermined time, and maintains the desired temperature of 22° C. for a preset time, the processor 120 may store 22° C. which is relatively high as the target temperature of the first indoor unit. This is to minimize the amount of power consumed by the air conditioning device 10 while maintaining the user's pleasantness.

The processor 120, in changing the temperature set in at least one indoor unit 12 included in the group that is the target of the driving control to the target temperature, may sequentially change the temperature of the indoor unit 12. For example, if the temperature around the indoor unit 12 included in the group subject to driving control is 20° C. and the target temperature of the indoor unit 12 is 22° C., the processor 120 may change the temperature of the indoor unit 12 set to 20° C. to 21° C. firstly, and may change the temperature of the indoor unit 12 after the preset time (e.g., ten minutes) to the target temperature of 22° C. This is to minimize the unpleasantness of the user that occurs when the setting temperature is changed suddenly.

When the temperature set to the at least one indoor unit 12 included in the group subject to driving control is changed to the target temperature, the processor 120 may identify whether the amount of power consumed by a plurality of air conditioning device 10 reaches the reference power amount. When it is identified that the amount of power consumed by a plurality of air conditioning device 10 reaches the reference power amount, the processor 120 may identify a second group with a relatively low control priority than the first group subject to driving control based on information about the control priority, and may transmit a signal for driving control to at least one indoor unit included in the second group through the communicator 110.

For example, referring to FIGS. 3A and 3B, the processor 120 may identify a second group including third and fourth indoor units having a control valve having a relatively long opening and closing cycle relative to the first group but having a relatively short opening and closing cycle relative to the third group as a group subject to second driving control, and may identify a third group including a fifth indoor unit connected to a pipe including a control valve having a relatively long opening and closing cycle to a group that is a target of the third driving control. The processor 120 may transmit a signal for driving control to the at least one indoor unit included in the second group through the communicator 110. The processor 120 may transmit a signal for changing the temperature set to at least one indoor unit included in the second group to at least one indoor unit included in the second group through the communicator 110. Even if it is identified that the amount of power consumed by the plurality of the air conditioning devices 10 reaches the reference power amount even if the temperature set in the at least one indoor unit included in the second group changes to the target temperature, the processor 120 may transmit a signal for changing the temperature set in the at least one indoor unit included in the third group to the target temperature to the at least one indoor unit included in the third group through the communicator 110.

When the temperature set to at least one indoor unit 12 included in each of the plurality of groups to the target temperature, the processor 120 may identify whether the power consumed by the plurality of the air conditioning devices 10 reaches the reference power amount. In the embodiment described above, when the plurality of indoor units 12 included in the first to third groups are changed to the target temperature, the amount of power consumed by the plurality of the air conditioning devices 10 may be identified to reach the reference power amount.

If it is identified that the power consumed by the plurality of air conditioning devices 10 reaches the reference power amount, the processor 120 may transmit a signal to close the control valve to at least one indoor unit included in the first group through the communicator 110. If it is identified that the amount of power consumption reaches the reference power amount even when the plurality of the air conditioning devices 10 is driven at the target temperature, the processor 120 may control at least one indoor unit included in the first group so that at least one indoor unit included in the first group performs the blowing operation.

The processor 120 may identify if the amount of power consumed by the plurality of the air conditioning devices 10 reaches the reference power consumption amount if the control valve of the at least one indoor unit 12 included in the first group is closed. If the processor 120 identifies that the amount of power consumed by the plurality of the air conditioning devices 10 reaches the reference power amount, the processor 120 may transmit a signal to close the control valve to at least one indoor unit included in the second group having a lower control priority than the first group. If the amount of power consumed by the plurality of the air conditioning devices 10 is identified to reach the reference power amount even when the control valve of the at least one indoor unit included in the second group is closed, the processor 120 may transmit a signal for closing the control valve to at least one indoor unit included in the third group through the communicator 110.

The processor 120 may identify if the amount of power consumed by the plurality of the air conditioning devices 10 reaches the reference power amount when the control valve of the at least one indoor unit 12 included in each of the plurality of groups is closed. In the embodiment described above, when the control valve of the plurality of indoor units 12 included in the first to third groups is closed, whether the amount of power consumed by the plurality of the air conditioning devices 10 reaches the reference power amount may be identified. If the processor 120 identifies that the amount of power consumed by the plurality of the air conditioning devices 10 reaches the reference power amount, the processor 120 may transmit a signal for turning off power to the at least one indoor unit included in the first group through the communicator 110. The processor 120 may identify whether the amount of power consumed by the plurality of the air conditioning devices 10 reaches the reference power amount when the power of at least one indoor unit 12 included in the first group is turned off. If the processor 120 identifies that the amount of power consumed by the plurality of the air conditioning devices 10 reaches the reference power amount, the processor 120 may transmit a signal for turning off to the at least one indoor unit included in the second group having a lower control priority than the first group through the communicator 110. If the power consumed by the plurality of the air conditioning device 10 is identified to reach the reference power amount even if the power of at least one indoor unit included in the second group is turned off, the processor 120 may transmit a signal for turning off to the at least one indoor unit included in the third group through the communicator 110.

Accordingly, embodiments of the disclosure may efficiently manage a plurality of air conditioning devices in group units and minimize user unpleasantness.

The control valve may be included in the pipe connecting the outdoor unit 11 and the indoor unit 12, the position of the control valve is not limited thereto. That is, the control valve may be installed at various locations of the air conditioning device 10. According to an embodiment, the control valve may be a valve that is included in a pipe connected between the compressor of the outdoor unit 11 and the evaporator of the outdoor unit 11 to control the refrigerant flowing to the evaporator, and may be a valve included in the pipe connected between the compressor and the condenser of the outdoor unit 11 to control the refrigerant flowing to the compressor.

It has been described that the air conditioning device 10 operates in a cooling cycle, but the disclosure may be applied to a similar technical idea even when the air conditioning device 10 operates in a heating cycle.

Figure 4A:
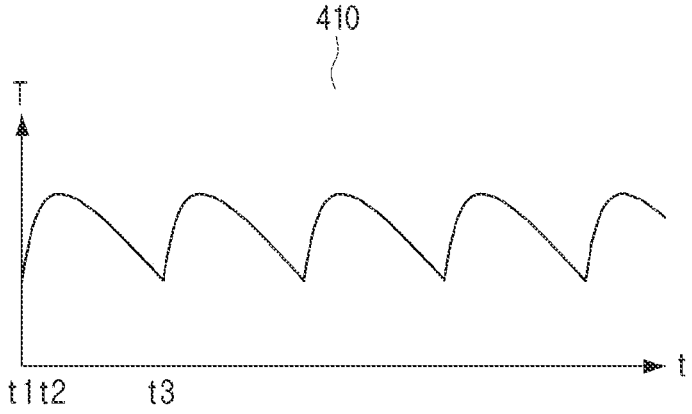
FIGS. 4A, and 4B, and 4C are diagrams illustrating grouping a plurality of indoor units based on an internal temperature according to various embodiments of the disclosure.
Figure 4B:
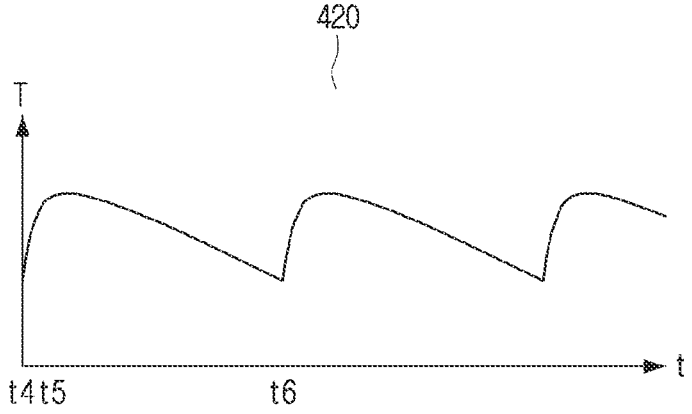
Figure 4C:
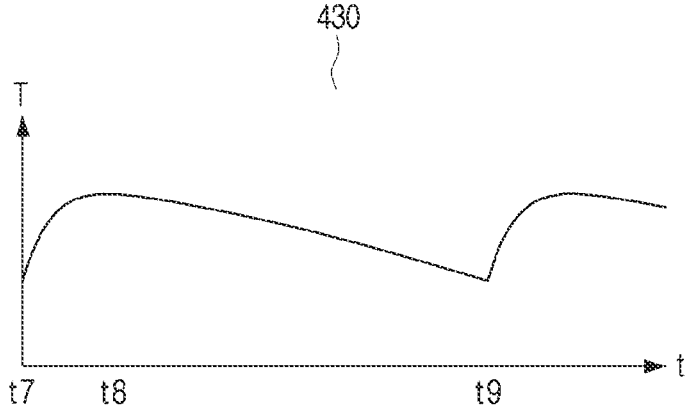

FIGS. 4A to 4C are diagrams illustrating an embodiment of grouping a plurality of indoor units based on an internal temperature according to various embodiments of the disclosure.

Referring to FIGS. 4A to 4C, an embodiment of grouping a plurality of indoor groups based on the opening and closing period of the control valve is described. However, in one embodiment, the processor 120 may group a plurality of indoor units into a plurality of groups based on the temperature sensed by each indoor unit of the plurality of the air conditioning devices 10.

The processor 120 may receive the driving information of a plurality of the air conditioning devices 10 through the communicator 110. The driving information may include information about indoor temperature detected by each indoor unit 12 of the plurality of the air conditioning devices 10. The processor 120 may group each indoor unit of the plurality of the air conditioning devices 10 based on a change period of the indoor temperature.

The processor 120 may identify a change cycle of indoor temperature based on information on indoor temperature included in the driving information. The processor 120 may identify a first time point when the indoor temperature rises, and a second time point at which the rising indoor temperature drops and then rises again, based on the information about the indoor temperature, and may identify a change cycle of the indoor temperature based on the first and second time points. For example, if the first time point is t1 and the second time point is t2, the processor 120 may identify the difference between t2 and t1 as a change cycle of the indoor temperature.

The processor 120 may group each indoor unit 12 of the air conditioning device 10 into a plurality of groups based on a change cycle of the indoor temperature. The processor 120 may group the indoor unit 12 with the same indoor temperature change cycle into the same group among a plurality of indoor units 12. For example, if the change cycle of the indoor temperature identified based on the indoor temperature sensed by the first and second indoor units is T1 and the change cycle of the indoor temperature identified based on the indoor temperature sensed by the third and fourth indoor units is T2, the processor 120 may group the first and second indoor units into the first group and may group the third and fourth indoor units to the second group. The processor 120 may group the indoor unit 12 with a similar indoor temperature change cycle into the same group. The processor 120 may group the first and second indoor units in the same group if the change cycle of the indoor temperature identified based on the indoor temperature sensed by the first indoor unit is T1 and the change cycle of the indoor temperature identified based on the indoor temperature detected by the second indoor unit is T2, and the difference between T1 and T2 is less than or equal to a threshold value (e.g., one minute).

Referring to FIGS. 4A to 4C, if the processor 120 receives information 410 about a first indoor temperature change cycle from the first and second indoor units, receives information 420 about a second indoor temperature cycle from the third and fourth indoor units, and receives information 430 about the third indoor temperature change cycle from the fifth indoor unit, the processor 120 may group first and second indoor units having an indoor temperature change cycle having the same (or similar) into the first group, may group the third and fourth indoor units into a second group, and may group the fifth indoor unit into a third group.

Figure 5:
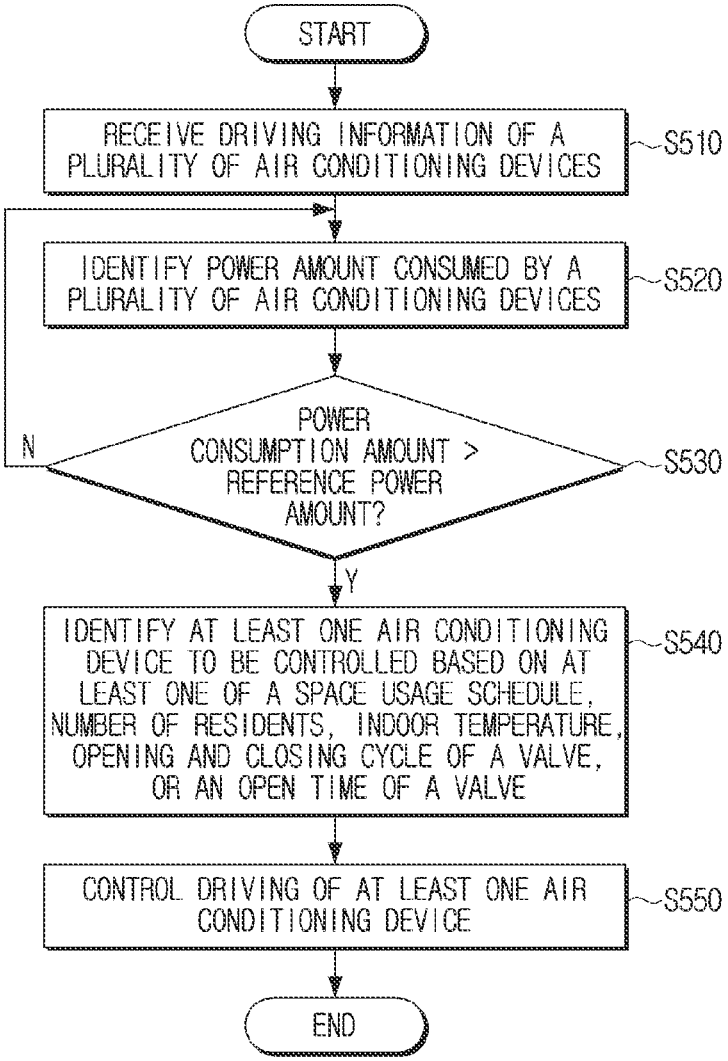
FIG. 5 is a flowchart illustrating an embodiment of controlling driving of an air conditioning device according to an embodiment of the disclosure.

FIG. 5 is a flowchart illustrating an embodiment of controlling driving of an air conditioning device according to an embodiment of the disclosure.

Referring to FIG. 5, as described above, the processor 120 may receive the driving information of the plurality of the air conditioning device 10 at operation S510 and identify the amount of power consumed by the plurality of the air conditioning device 10 at operation S520. The processor 120 may identify whether the amount of power consumption has reached the reference power quantity at operation S530. If the processor 120 identifies that the amount of power consumption has not reached the reference power amount, the processor 120 may continuously identify (or monitor) the amount of power consumed by the plurality of the air conditioning devices 10 at operation S520. If the processor 120 identifies that the amount of power consumption reaches the reference power amount, the processor 120 may identify the air conditioning device 10 to be controlled based on the information on the control priority.

The processor 120 may identify at least one air conditioning device to be controlled based on at least one of a space usage schedule, the number of residents, an indoor temperature, an opening/closing cycle of a control valve, and an open time of the control valve at operation S540.

The space usage schedule may be information on a schedule of a space in which each indoor unit of the plurality of the air conditioning device 10 is installed. In one example, if information about a usage schedule is stored for the first space and information on a usage schedule for the second space is not stored, the processor 120 may first control the indoor unit installed in the second space among the indoor units installed in the first space and the indoor units installed in the second space. That is, the processor 120 may control the signal for driving control of the indoor unit by the indoor unit installed in the second space.

The processor 120 may identify at least one air conditioning device to be controlled based on the resident number when the information on the schedule for space use is stored in the plurality of spaces. The processor 120 may identify an indoor unit installed in a space having a small number of residents to an indoor unit to be controlled. As an example, when both the first and second spaces are used by the user, the processor 120 may identify the number of residents in the first space and the second space, and may identify the indoor unit of the space in which a relatively small number of residents are included, among the first and second spaces, as the indoor unit to be controlled first. The processor 120 may identify the number of residents of each space based on information on the number of residents included in the information about the schedule. Alternatively, the processor 120 may identify the number of residents of each space based on information on the number of residents sensed by an external device. The external device may be a variety of electronic devices capable of sensing a user, such as a camera, an infrared sensor, etc.

The processor 120 may identify at least one air conditioning device to be controlled based on the indoor temperature of each space if it is identified that the number of residents in each space is the same. The processor 120 may identify an indoor unit installed in a space having a low indoor temperature to an indoor unit to be controlled first. In one example, the processor 120 may identify the indoor temperature of the first space and the indoor temperature of the second space when the first and second spaces are used by the user, and the residents of the first and second spaces are the same, and identify the indoor temperature of the first space and the second space which is relatively low as the indoor unit to be controlled first. The processor 120 may receive information about indoor temperature from each indoor unit 12 of the plurality of the air conditioning devices 10. When the indoor temperature is low, even if the driving of an indoor unit is controlled, the user's pleasantness may be maintained to some degree.

If the indoor temperature of each space is equal (or a difference below a threshold value), the processor 120 may identify a group in which the opening/closing cycle of the control valve is included among the plurality of groups, and may perform the driving control of the indoor unit included in the corresponding group. The operation associated with the opening and closing cycle of the control valve is described above and will not be further described.

The processor 120 may identify at least one air conditioning device to be controlled based on the time at which the control valve is open if the opening and closing cycle of the control valve of each indoor unit is the same (or a difference below a threshold value). The processor 120 may identify an indoor unit including a control valve opened for a relatively long period of time as an indoor unit to be controlled. For example, if the first and second spaces are being used by the user and the number of residents of the first and second spaces are the same (or a difference less than or equal to a threshold value), and the indoor temperature of the first space and the second space is the same (or a difference less than or equal to a threshold value), the processor 120 may identify the indoor unit which opens a control valve for a relatively long time among the indoor units of each space, as the indoor unit to be controlled first. When the control valve opening/closing cycle of the first and second indoor units is T, and during the period T, the first indoor unit opens the control valve for t1, and the second indoor unit opens the control valve for t2, and if t1 is greater than t2, the processor 120 may identify the first indoor unit as an indoor unit to be controlled. The processor 120 may receive information on the opening and closing time of a control valve received from each indoor unit 12 of a plurality of the air conditioning devices 10. This considers that, when the control valve is opened for a long time, the space in which the indoor unit including the control valve is installed has high thermal load and the power consumption of the indoor unit is high.

The processor 120 may control driving of at least one air conditioning device to be controlled at operation S550.

The server 100 may efficiently use power while minimizing the unpleasantness of a user by controlling the driving of the air conditioning device 10 determined through various factors, such as a space usage schedule, a resident number, an indoor temperature, an opening/closing cycle of the valve, and an opening time of a valve, or the like.

Figure 6:
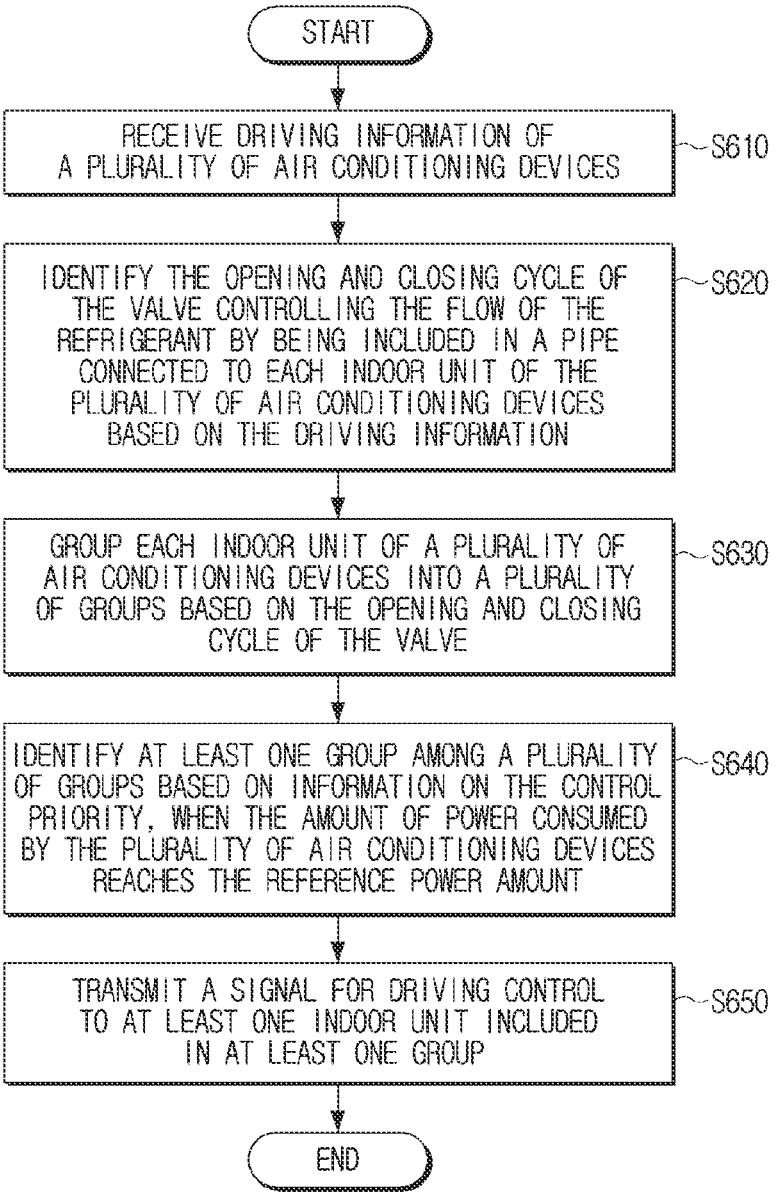
FIG. 6 is a flowchart illustrating an operation of a server according to an embodiment of the disclosure.

FIG. 6 is a flowchart illustrating an operation of a server according to an embodiment of the disclosure.

Referring to FIG. 6, the server 100 may receive driving information of a plurality of air conditioning devices 10 at operation S610. The driving information may be at least one of information about the driving mode of each indoor unit 12 of the plurality of the air conditioning devices 10, information about the temperature set in each indoor unit 12, information on the opening and closing time of the control valve controlling the flow of the refrigerant, and information on the frequency of the power applied to the motor included in each outdoor unit 11.

The server 100 may identify the opening and closing cycle of the valve controlling the flow of the refrigerant by being included in a pipe connected to each indoor unit of the plurality of air conditioning devices based on the driving information at operation S620.

The server 100 may receive information about the opening and closing time of the control valve including open time and the closed time of the control valve of each indoor unit from the air conditioning device 10. The server 100 may identify the opening and closing cycle of the control valve based on information on the opening and closing time of the control valve included in the driving information. The server 100 may identify the second time point when the closed control valve is closed again after the closed control valve is opened from the first time point when the control valve is closed, based on the information on the opening and closing time of the control valve, and may identify the opening and closing cycle of the control valve based on the first and second time points.

The server 100 may group each indoor unit of a plurality of air conditioning devices into a plurality of groups based on the opening and closing cycle of the valve at operation S630.

The server 100 may group the indoor unit 12 having an opening and closing cycle having the same opening/closing cycle or difference less than or equal to a threshold value, among a plurality of indoor units 12, into a same group. In one example, the processor 120 may group the first and second indoor units in the same group if the opening and closing cycle of the control valve included in the first indoor unit is T1 and the control valve included in the second indoor unit is T2, and the difference between T1 and T2 is less than or equal tot threshold value (e.g., one minute).

The server 100 may group each indoor unit 12 of the plurality of the air conditioning devices 10 into a plurality of groups based on a change cycle of the indoor temperature. The server 100 may group a plurality of indoor units 12 with the same temperature change cycle or with a temperature change cycle having a difference less than or equal to a threshold value, among the plurality of indoor units 12, into a same group.

The server 100 may group each indoor unit 12 into a plurality of groups based on information on the frequency of the power supplied to the motor included in each outdoor unit 11. The motor may be a motor operating the compressor included in each outdoor unit 11 of the air conditioning device 10. The server 100 may identify a cycle in which the frequency of the power supplied to the motor included in each outdoor unit is changed, and may group the indoor unit 12 connected to the outdoor unit 11 having the same frequency change cycle (or having a difference below or equal to a threshold value) into the same group. This may be the embodiment when the air conditioning device 10 operates in an inverter manner.

The server 100 may identify at least one group among a plurality of groups based on information on the control priority, when the amount of power consumed by the plurality of air conditioning devices reaches the reference power amount at operation S640.

The server 100 may identify a group including an indoor unit having a relatively short valve opening and closing cycle among a plurality of groups, and may transmit a signal for driving control to at least one indoor unit included in the identified group.

The server 100 may identify the air conditioning device 10 to be controlled by considering at least one of the space usage schedule, the resident number, the indoor temperature, and the opening time of the control valve.

The server 100 may transmit a signal for driving control to at least one indoor unit included in at least one group at operation S650. The signal for driving control may be at least one of a signal for changing the temperature set in the outdoor unit 11, a signal for closing the valve for controlling the flow of the refrigerant, or a signal to turn off the power of the indoor unit 12.

The disclosure may increase the efficiency of power usage and reduce the burden of a building manager by controlling an indoor unit having high power consumption in group units.

The methods according to various embodiments of the disclosure may be implemented as a format of software or application installable to a related art server.

The methods according to various embodiments of the disclosure may be implemented by software upgrade of a related art server, or hardware upgrade only.

A non-transitory computer readable medium which stores a program for sequentially executing a method for controlling a server according to an embodiment may be provided.

The non-transitory computer readable medium refers to a medium that is readable by an apparatus. The aforementioned various applications or programs may be stored in the non-transitory computer readable medium, for example, a compact disc (CD), a digital versatile disc (DVD), a hard disk, a Blu-ray disc, a universal serial bus (USB), a memory card, a read only memory (ROM), and the like, and may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A server comprising:

a communicator;

a processor; and a memory storing instructions which, when executed by the processor, cause the processor to:

receive, through the communicator, driving information of a plurality air conditioning devices, based on the driving information, identify an opening and closing cycle of a plurality of valves controlling flow of a refrigerant included in a plurality of pipes connected to a plurality of indoor units of the plurality of air conditioning devices, respectively, based on the opening and closing cycle of each of the plurality of valves, group the plurality of indoor units of the plurality of air conditioning devices into a plurality of groups, in response to a power consumed by the plurality of air conditioning devices being equal to or greater than a reference power amount, identify at least one group among the plurality of groups based on information about a control priority, and transmit, through the communicator, a signal for driving control to at least one indoor unit included in the at least one group, to control the at least one indoor unit to at least one of:

change a temperature set in the at least one indoor unit to a target temperature when the temperature set is maintained for a predetermined time;

close a valve in a pipe of the plurality of pipes connected to the at least one indoor unit to control the flow of the refrigerant; or turn off power of the at least one indoor unit having a lower control priority than other indoor units in the at least one group to increase an efficiency of power consumption of the plurality of air conditioning devices.

2. The server of claim 1, wherein the instructions, when executed by the processor, further cause the processor to:

receive, through the communicator, the driving information comprising information about an opening and closing time of the valve including an opening time of the valve and a closing time of the valve, and based on the information about the opening and closing time of the valve, identify an opening and closing cycle of the valve.

3. The server of claim 2, wherein the instructions, when executed by the processor, further cause the processor to:

in response to the valve being closed after the valve is closed at a first point of time, identify a second point of time, and based on the first point of time and the second point of time, identify the opening and closing cycle of the valve.

4. The server of claim 3, wherein the first point of time is a time when the valve is closed based on temperature around an indoor unit being equal to or greater than a temperature set to the indoor unit.

5. The server of claim 1, wherein the instructions, when executed by the processor, further cause the processor to:

based on the information about the control priority, identify a group including an indoor unit connected with a pipe including the valve with an opening and closing cycle that is shorter among the plurality of groups, and transmit, through the communicator, the signal for driving control to one or more indoor units included in the group.

6. The server of claim 1, wherein the instructions, when executed by the processor, further cause the processor to transmit, through the communicator to the at least one indoor unit, the signal to change the temperature set to the at least one indoor unit to a target temperature based on information about the target temperature matched to the plurality of indoor units of the plurality of air conditioning devices.

7. The server of claim 6, wherein the instructions, when executed by the processor, further cause the processor to:

based on the temperature set to the at least one indoor unit being changed to the target temperature, identify whether a power consumption amount consumed by the plurality of air conditioning devices is equal to or greater than the reference power amount, and in response to identifying that the power consumption amount consumed by the plurality of air conditioning devices is equal to or greater than the reference power amount, identify a second group with a priority that is lower than a first group including the at least one indoor unit based on the information about the control priority, and transmit, through the communicator, the signal for driving control to at least one indoor unit included in the second group.

8. The server of claim 7, wherein the instructions, when executed by the processor, further cause the processor to transmit, through the communicator to the at least one indoor unit included in the second group, a signal to change the temperature set to the at least one indoor unit included in the second group to the target temperature.

9. The server of claim 8, wherein the instructions, when executed by the processor, further cause the processor to:

based on the temperature set to at least one indoor unit included in each of the plurality of groups being changed to the target temperature, identify whether the power consumption amount consumed by the plurality of air conditioning devices is equal to or greater than the reference power amount, and in response to identifying that the power consumption amount consumed by the plurality of air conditioning devices is equal to or greater than the reference power amount, transmit, through the communicator, the signal to close the valve to the at least one indoor unit included in the first group.

10. The server of claim 9, wherein the instructions, when executed by the processor, further cause the processor to:

based on the valve of the at least one indoor unit included in the each of the plurality of groups being closed, identify whether the power consumption amount consumed by the plurality of air conditioning devices is equal to or greater than the reference power amount, and based on identifying that the power consumption amount consumed by the plurality of air conditioning devices is equal to or greater than the reference power amount, transmit, through the communicator to the at least one indoor unit included in the first group, a signal to turn off the at least one indoor unit included in the first group.

11. A control method of a server, the method comprising:

receiving driving information of a plurality air conditioning devices;

based on the driving information, identifying an opening and closing cycle of a plurality of valves controlling flow of a refrigerant included in a plurality of pipes connected to a plurality of indoor units of the plurality of air conditioning devices, respectively;

based on the opening and closing cycle of the plurality of valves, grouping the plurality of indoor units of the plurality of air conditioning devices into a plurality of groups;

in response to a power consumed by the plurality of air conditioning devices being equal to or greater than a reference power amount, identifying at least one group among the plurality of groups based on information about a control priority; and transmitting a signal for driving control to at least one indoor unit included in the at least one group, to control the at least one indoor unit to at least one of:

change a temperature set in the at least one indoor unit to a target temperature when the temperature set is maintained for a predetermined time, close a valve in a pipe of the plurality of pipes connected to the at least one indoor unit to control the flow of the refrigerant, or turn off power of the at least one indoor unit having a lower control priority than other indoor units in the at least one group to increase an efficiency of power consumption of the plurality of air conditioning devices.

12. The method of claim 11, wherein the driving information comprises information about an opening and closing time of the valve including an opening time of the valve and a closing time of the valve, and wherein identifying an opening and closing cycle of the valve comprises identifying the opening and closing cycle of the valve based on the information about the opening and closing time of the valve.

13. The method of claim 12, wherein the identifying the opening and closing cycle of the valve comprises:

identifying a second point of time when the valve is closed after the valve is closed at a first point of time; and identifying the opening and closing cycle of the valve based on the first point of time and the second point of time.

14. The method of claim 13, wherein the first point of time is a time when the valve is closed in response to temperature around the at least one indoor unit being equal to or greater than a temperature set to the at least one indoor unit.

15. The method of claim 11, wherein the transmitting of the signal for driving control comprises:

based on the information about the control priority, identifying a group comprising an indoor unit connected with a pipe including the valve with an opening and closing cycle that is shorter among the plurality of groups; and transmitting the signal for driving control to one or more indoor units included in the group.

16. The method of claim 11, wherein the transmitting of the signal for driving control comprises transmitting, to the at least one indoor unit, the signal to change the temperature set to the at least one indoor unit to a target temperature based on information about the target temperature matched to the plurality of indoor units of the plurality of air conditioning devices.

17. The method of claim 16, wherein the transmitting of the signal or driving control comprises:

based on the temperature set to the at least one indoor unit being changed to the target temperature, identifying whether a power consumption amount consumed by the plurality of air conditioning devices is greater than or equal to the reference power amount; and in response to identifying that the power consumption amount consumed by the plurality of air conditioning devices is greater than or equal to the reference power amount, identifying a second group with a priority that is lower than a first group including the at least one indoor unit based on the information about the control priority, and transmitting the signal for driving control to at least one indoor unit included in the second group.

18. The method of claim 17, wherein the transmitting of the signal for driving control comprises transmitting, to the at least one indoor unit included in the second group, a signal to change the temperature set to the at least one indoor unit included in the second group to the target temperature.

19. The method of claim 18, wherein the transmitting of the signal for driving control comprises:

based on the temperature set to at least one indoor unit included in each of the plurality of groups being changed to the target temperature, identifying whether the power consumption amount consumed by the plurality of air conditioning devices is equal to or greater than the reference power amount; and based on identifying that the power consumption amount consumed by the plurality of air conditioning devices is equal to or greater than the reference power amount, transmitting, to the at least one indoor unit included in the first group, the signal to close the valve.

20. The method of claim 19, wherein the transmitting of the signal for driving control comprises:

based on the valve of the at least one indoor unit included in the each of the plurality of groups being closed, identifying whether the power consumption amount consumed by the plurality of air conditioning devices is equal to or greater than the reference power amount; and based on identifying that the power consumption amount consumed by the plurality of air conditioning devices is equal to or greater than the reference power amount, transmitting, to the at least one indoor unit included in the first group, a signal to turn off the at least one indoor unit included in the first group.

* * * * *